United States Patent [19]

Vavlitis

[11] Patent Number: 4,844,136

[45] Date of Patent: Jul. 4, 1989

[54] SAIL FURLER

[76] Inventor: Jason Vavlitis, 191 Winthrop Rd., Brookline, Mass. 02111

[21] Appl. No.: 147,199

[22] Filed: Jan. 22, 1988

[51] Int. Cl.[4] ..... B63H 9/04

[52] U.S. Cl. ..... 114/104; 114/39.1; 114/108

[58] Field of Search ..... 114/102–106, 114/109, 39.1, 39.2

[56] References Cited

U.S. PATENT DOCUMENTS

| | | | |
|---|---|---|---|
| 639,916 | 12/1899 | Achterberg | 114/105 |
| 843,822 | 2/1907 | Jennings | 114/105 |
| 1,376,170 | 4/1921 | Shann | 114/104 |
| 3,800,728 | 4/1974 | Dowling | 114/105 |
| 4,280,431 | 7/1981 | Sofen | 114/105 |
| 4,347,799 | 9/1982 | Moriarty | 114/102 |
| 4,354,444 | 10/1982 | Puretic | 114/105 |
| 4,388,888 | 6/1983 | Gushurst | 114/90 |
| 4,474,127 | 10/1984 | Stevenson | 114/104 |
| 4,487,147 | 12/1984 | Hoyt | 114/104 |
| 4,688,506 | 8/1987 | Van Breems | 114/105 |
| 4,745,871 | 5/1988 | Wieder | 114/105 |

OTHER PUBLICATIONS

Cruising World, Jun. 1985, p. 188.

*Primary Examiner*—Joseph F. Peters, Jr.
*Assistant Examiner*—Clifford T. Bartz

[57] ABSTRACT

A device for furling a sail comprising; a support structure, means for mounting the support structure to a boom of a sailboat; a retaining structure fixed to the support structure; and an elongated sail furling guide structure removably secured in the retaining structure and positioned for guiding a sail to a furled condition on the boom when the support structure is fixed to the boom and the sail furling guide structure is inserted in the retaining structure.

14 Claims, 2 Drawing Sheets

SAIL FURLER

BACKGROUND OF THE INVENTION

This invention relates to a method and apparatus for furling a sail.

When a sail is lowered to the boom of a boat, it is frequently folded and secured to the boom to prevent blocking the helmsman's vision, and to avoid spoiling the shape of the sail while reducing its bulk.

Sofen U.S. Pat. No. 4,280,431, describes a device which clamps around the boom and has two arms which help to catch a sail and may then be connected together around the sail.

Puretic, U.S. Pat. No. 4,354,444, describes a pair of generally triangular panels secured along a boom which act as a sail-receiving pocket.

Moriarty, U.S. Pat. No. 4,347,799, describes a sail catcher having two arm pairs pivotally mounted on the boom. In the extended portion the arms form a basket-like structure useful for catching the sail as it is lowered.

SUMMARY OF THE INVENTION

In a first aspect, the invention features a device for furling a sail. The device is provided with a support structure, means for mounting the support structure to a boom of a sailboat; a retaining structure fixed to the support structure; and an elongated sail furling guide structure removably secured in the retaining structure and positioned for guiding a sail to a furled condition on the boom when the support structure is fixed to the boom and the sail furling guide structure is inserted in the retaining structure.

In the preferred embodiments, the support structure lies in a generally vertical plane on the boom, and the guide structure lies in a second plane offset from the vertical plane when the guide structure is inserted in the retaining structure; the rod retainer comprises a stop structure at one end; and the guide structure lies in a plane tilted away approximately four degrees from the vertical plane; the elongated sail furling guide is a rod; the retaining structure is a tube; the support structure is a plane; and the guide structure is a rod.

In a second aspect, the invention features a sailboat having a boom suitable for holding a mainsail of a boat. The boom includes a plurality of support structures suitable for removably accepting an elongated sail furling guide structure and for holding the guide structure in an upwardly projecting position on the boom.

In preferred embodiments, the support structures are mounted on the boom in pairs, each structure of a pair being mounted on opposite sides of the boom; and the support structure is a channel drilled in the boom.

In a third aspect, the invention features a method for furling a sail on the above described boat. The method includes the steps of attaching a sail to the boom, raising the sail, inserting an elongated sail furling guide structure into each support structure, lowering the sail to the boom, wherein the guide structures cause the sail to be furled, fastening the sail to the boom, and removing the guide structures from the support structures.

The invention provides the advantage of saving the time that is required to manually fold a sail to a boom before securing it to the boom. It further reduces the difficulty of such a procedure in rough weather conditions.

The sail catcher can be easily fabricated and is relatively inexpensive. Its simple construction allows a solid rod to be easily mounted to the plate for guiding the sail to a folded condition on the boom when it is lowered. The rod may also be easily removed to prevent a dangerous obstacle for crewmen and preserve the overall appearance of the boat.

Other advantages and features will become apparent from the following description of the preferred embodiment and from the claims.

DESCRIPTION OF THE PREFERRED EMBODIMENT

We first briefly describe the Figures.

DRAWINGS

STRUCTURE

Figure 2:
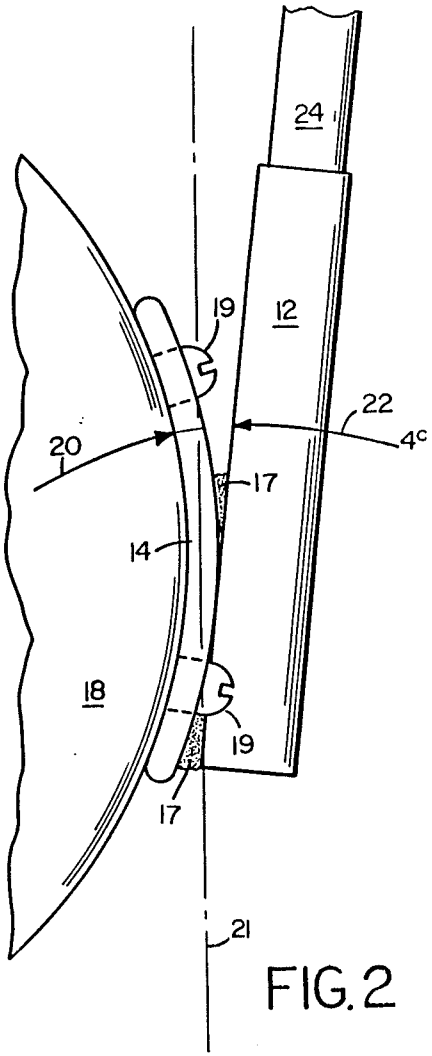
FIG. 2 is a side view of the bracket mounted to the boom of a sailboat.
Figure 1:
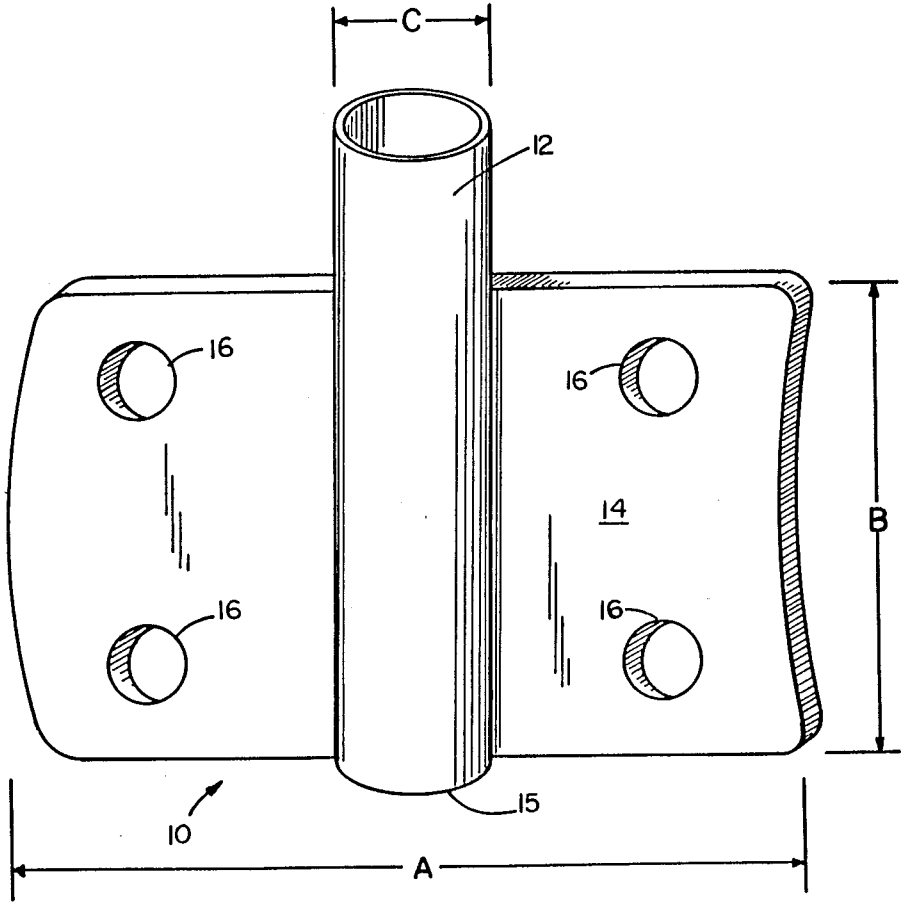
FIG. 1 is a perspective view of a bracket having an arched plate.

Referring to FIGS. 1 and 2 a small metal, e.g., aluminum or stainless steel, or plastic bracket 10 includes a retaining tube 12 and an arched rectangular support plate 14. Tube 12 is closed at its bottom 15 and attached to the center of plate 14 by solder 17 or may be welded or glued in place. Plate 14 is arched and may have any radius of curvature that will enable it to be squarely or snugly mounted on a boom 18 of a sailboat (FIG. 2). Preferably, the dimensions of plate 14 are A, 5 inches wide, B, 2 inches long and 1/10 of an inch thick. Tube 12 is approximately three inches long and has an inner diameter C of about ½ inch.

Plate 14 has four through holes 16 which allow it to be fastened to the side of a boom 18 by screws 19 (or rivets). Retaining tube 12 is tilted four to ten degrees (as indicated by arrows 20, 22) from a vertical position, shown by axis 21, and away from the top of plate 14. A solid aluminum rod 24 approximately 2–5 feet long and ½ inch in diameter is inserted within tube 12. The length of rod 24 may vary depending on the size of the sail to be caught.

OPERATION

Figure 4:
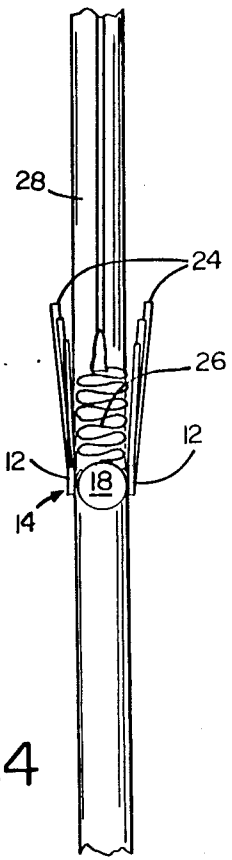
FIG. 4 is a perspective end view of the boom showing the brackets guiding the sail as it is lowered to the boom.
Figure 3:
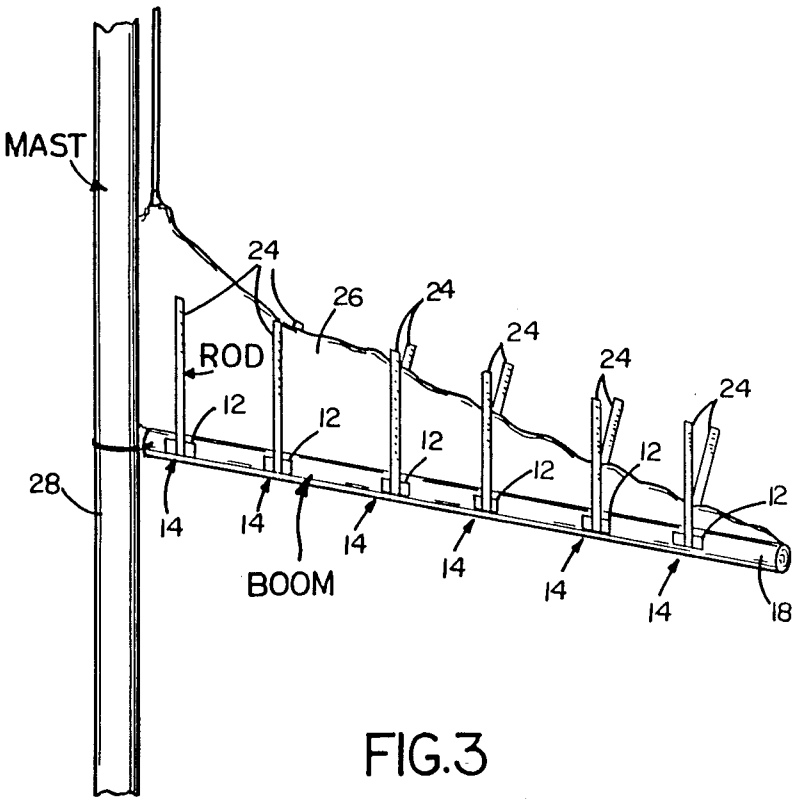
FIG. 3 is a perspective view of the boom having brackets mounted to it on each side of the sail.

Referring to FIGS. 3 and 4, an extended sail 26 is supported between a vertical mast 28 (64 feet in length) and horizontal boom 18 of boat 19. A series of six brackets 14 are secured to boom 18 along each side of sail 26. Before lowering sail 26, rods 24 of varying length are placed in each tube 12 of brackets 14. Shorter rod lengths are placed toward the end of boom 18 away from mast 28. (e.g., of size of sail and lengths of rods?) As sail 26 is lowered onto the boom, rods 24 provide excellent support for guiding the sail to form in folds between rods 24 on top of boom 18. the sail is thereafter secured with ties (not shown) and the rods 24 are removed.

OTHER EMBODIMENTS

Other embodiments are within the following claims. For example the lengths of rods 24 may be lengthened, or the rods curved to ensure that the sail will fall onto the boom even during rough weather conditions. The plate may be suitably shaped (e.g., oval, triangular, etc.) to fit any type of boom. A pocket or a tapered tube may be used instead of a tube closed at the bottom for retaining the rod. Further, the rod retainer may be an open cylinder, shaped to retain an elongated rod having a stop which prevents it falling through the rod retainer. The retainer may also be drilled holes in the boom.

What is claimed is:

1. A device for furling a sail comprising:

a support structure, means for mounting said support structure to a boom of a sailboat;

a retaining structure fixed to said support structure; and an elongated sail furling guide structure removably secured in said retaining structure and positioned for guiding a sail to a furled condition on said boom when said support structure is fixed to said boom and said sail furling guide structure is inserted in said retaining structure; said retaining structure and said guide structure being structured and configured to cooperate in a sliding fashion whereby said guide structure can be inserted in, held in, and subsequently removed from said retaining structure without any other fastening or removing means.

2. The device of claim 1 wherein said support structure lies in a generally vertically plane on said boom, and said guide structure lies in a second plane offset from said vertical plane when said guide structure is inserted in said retaining structure.

3. The device of claim 1 wherein said retaining structure comprises a stop structure at one end.

4. The device of claim 3 wherein said guide structure lies in a plane tilted away approximately four degrees from said vertical plane.

5. A sailboat having a boom suitable for holding a mainsail of a boat, said boom comprising a plurality of support structure, each said support structure being suitable for removably accepting an elongated sail furling guide structure and holding said guide structure in an upwardly projecting position on said boom, and a retaining structure fixed to said support structure said retaining structure and said guide structure being structured and configured to cooperate in a sliding fashion whereby said guide structure can be inserted in, held in, and subsequently removed from said retaining structure without any other fastening or removing means.

6. A method for furling a sail on a sailboat having a boom suitable for holding a mainsail of a boat, said boom comprising a plurality of support structures, each said support structure being suitable for removably accepting an elongated sail furling guide structure and holding said guide structure in an upwardly projecting position on said boom comprising the steps of attaching a sail to said boom, raising said sail, inserting an elongated sail furling guide structure into each said support structure, lowering said sail to said boom, wherein said guide structures cause said sail to be furled, fastening said sail to said boom, and removing said guide structure from said support structures.

7. The device of claim 1, 2, 3 or 4, wherein said support structure is a plate.

8. The device of claim 1, 2, 3 or 4, wherein said elongated sail furling guide is a rod.

9. The device of claim 1, 2, 3 or 4, wherein said retaining structure is a tube.

10. The sailboat of claim 5, wherein a said support structure is a plate.

11. The sailboat of claim 5, wherein a said guide structure is a rod.

12. The sailboat of claim 5, wherein said support structures are mounted on said boom in pairs, each support structure of said pair being mounted on opposite sides of said boom.

13. The sailboat of claim 5, wherein a said support structure is a channel drilled in said boom.

14. A method for furling a sail on a sailboat having a boom suitable for holding a mainsail of a boat, said boom comprising a plurality of support structures, each said support structure being suitable for removably accepting an elongated sail furling guide structure and holding said guide structure in an upwardly projecting position on said boom; wherein said retaining structure and said guide structure are structured and configured to cooperate in a sliding fashion whereby said guide structure can be inserted in, held in, and subsequently removed from said retaining structure without any other fastening or removing means, comprising the steps of attaching a sail to said boom, raising said sail, inserting an elongated sail furling guide structure into each said support structure, lowering said sail to said boom, wherein said guide structures cause said sail to be furled, fastening said sail to said boom, and removing said guide structure from said support structures.

* * * * *